United States Patent [19]

Tulenko, Jr.

[11] Patent Number: 4,508,038

[45] Date of Patent: Apr. 2, 1985

[54] COLLAPSIBLE END TABLE

[76] Inventor: William Tulenko, Jr., 8530 Wittner Rd., Pittsburgh, Pa. 15237

[21] Appl. No.: 506,507

[22] Filed: Jun. 21, 1983

[51] Int. Cl.[3] ..... A47B 3/00

[52] U.S. Cl. ..... 108/135; 297/135; 297/145

[58] Field of Search ..... 297/135, 145, 144, 147; 108/135, 134

[56] References Cited

U.S. PATENT DOCUMENTS

| | | | |
|---|---|---|---|
| 1,649,761 | 11/1927 | Vinegrad | 108/135 |
| 2,163,349 | 6/1939 | Olsen | 297/145 |
| 2,503,543 | 4/1950 | Caston | 297/145 |
| 2,518,381 | 8/1950 | Runkles | 297/145 |
| 2,639,761 | 5/1953 | Schenzinger et al. | 297/145 |
| 2,946,459 | 7/1960 | Rizzuto | 108/135 |

*Primary Examiner*—James T. McCall

*Attorney, Agent, or Firm*—William J. Ruano

[57] ABSTRACT

A collapsible end table unit which, in collapsed condition, occupies a very narrow space alongside a chair or sofa and is steadied or anchored by engaging, by a base extension, the underframe of the chair or sofa. The table may be pulled lengthwise and pivotally mounted on either side of the unit as desired or slid along the unit to form a desk top,—or separated entirely from the unit. The table, therefore, can be used as an end table, coffee table, desk, bar, drafting table, etc. The unit includes storage space for magazines, newspapers, and the like, as well as a top support for ashtrays tablelamps and other accessories.

4 Claims, 4 Drawing Figures

COLLAPSIBLE END TABLE

This invention relates to a furniture unit for housing a table, accessories, such as a table lamp or ashtray, as well as a storage area for magazines, newspapers and the like.

End tables occupy space which is at a premium in small apartments and are used only occasionally. While collapsible tables, such as bridge tables, are well known, they do not form any part of normally existing furniture decor, thereby creating a storage problem and the necessity of transporting them from the storage area to the site of use.

An object of the present invention is to overcome the abovenamed disadvantages by providing a novel collapsible unit which is a permanent piece of furniture anchored by the underside frame of a chair or sofa and which is versatile in the manner in which a table may be pulled out thereof and set up in a permanent manner.

Another object of the invention is to incorporate, in said collapsible unit, a storage area for papers and magazines and of accessories, such as a table lamp or ashtray.

Other objects and advantages of the invention will become more apparent from a study of the following description taken with the accompanying drawings wherein.

Figure 1:
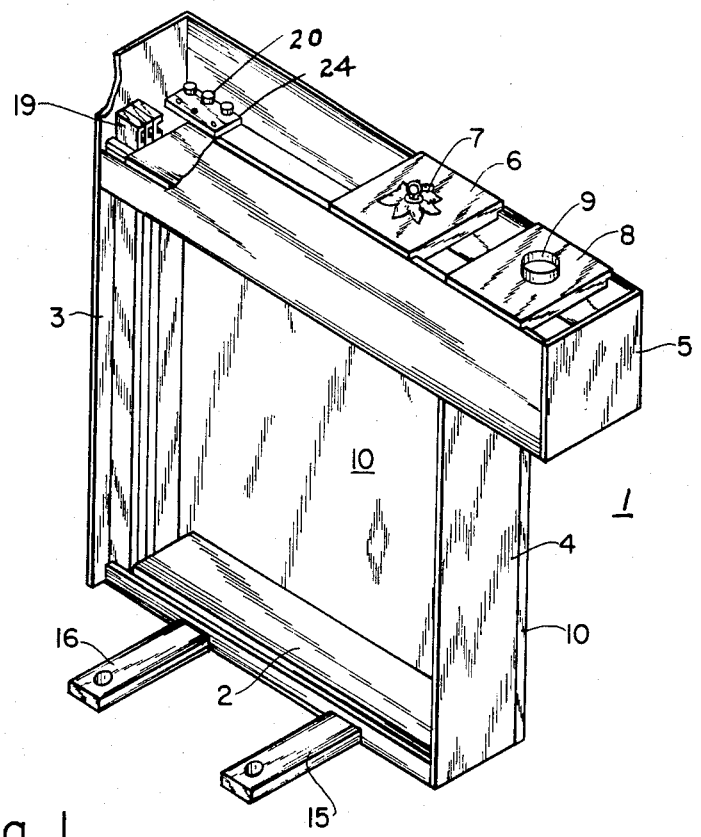
FIG. 1 is a top perspective view of a collapsible end table unit shown in fully collapsed condition.
Figure 4:
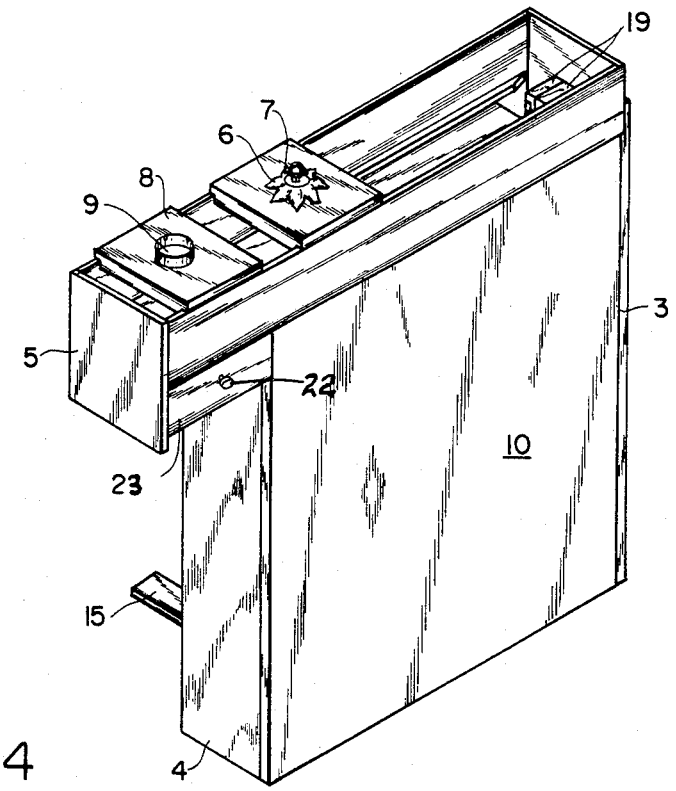
FIG. 4 is a top perspective view showing the end table as viewed oppositely to that shown in FIG. 1.

Referring more particularly to FIGS. 1 and 4 of the drawing, numeral 1 generally denotes a collapsible end table unit embodying the present invention. It includes a baseboard 2, side panels 3 and 4, and a box-like open top portion 5 on top of which there slidably mounted, a side grooved panel 6 which supports a lamp base 7 on which a lamp (not shown) may be mounted. Also, slidably mounted on top of the box-like unit 5, is a slidable panel 8 which supports an ashtray 9. A table 10 is shown in collapsed condition. Adequate storage space for magazines, etc. exists between table 10 and its opposite cover (not shown) in FIG. 1. The top of the table is slid by a knob 22 having a shank or pin slidable in a slot formed in the top horizontal frame of the unit.

Figure 2:
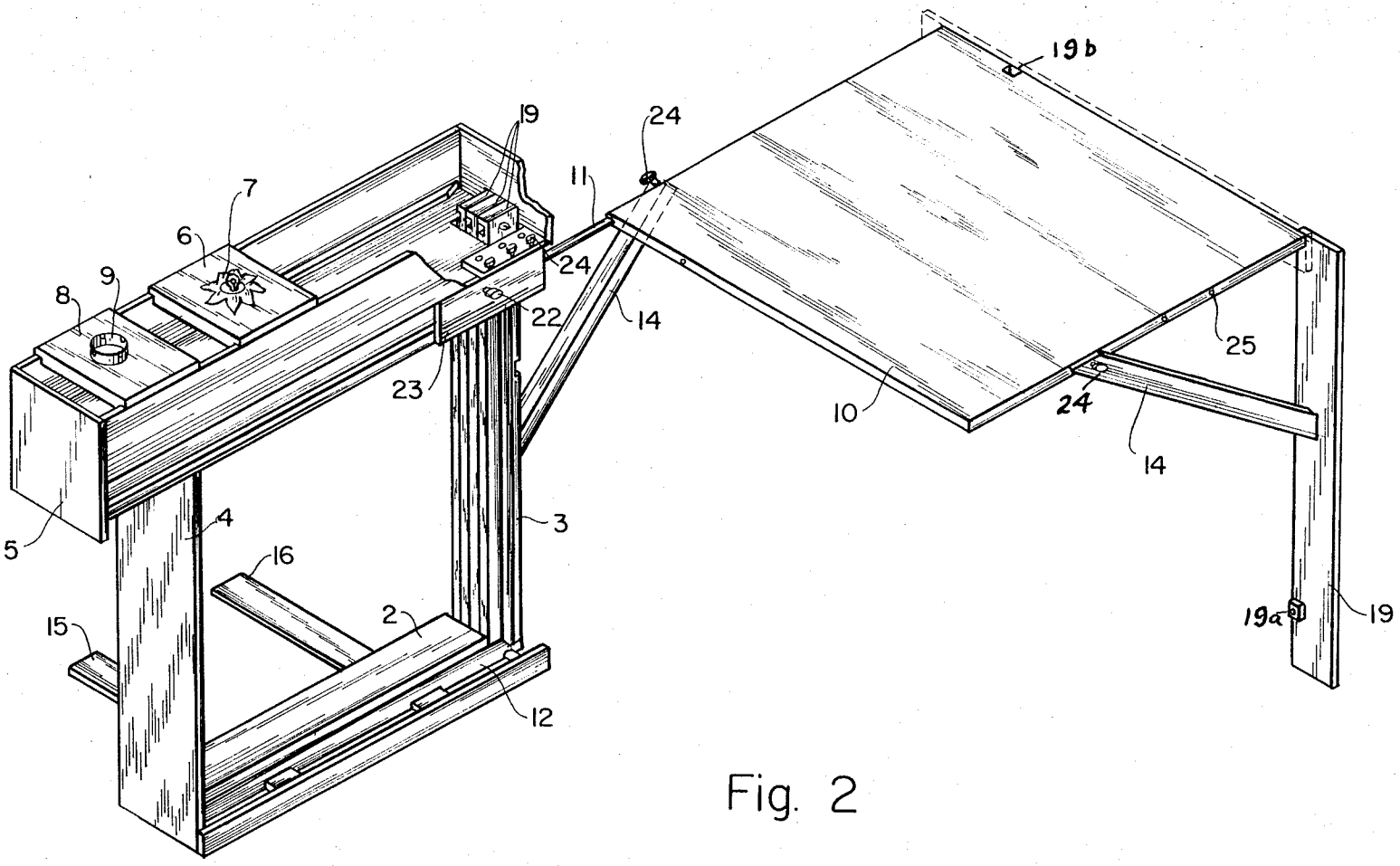
FIG. 2 is a top perspective view showing one position into which a collapsed tabletop may be erected to form an end table.

When it is desired to remove the table from the unit and to set it up as an end table, the table 10 is pulled out to the position shown in FIG. 2 by pulling on knob 22, thus sliding panel 23 and the table outwardly while it is sliding on the lower groove 12, and when freed of the groove, turning the table 10 about a pivot pin 11, mounted in slidable panel 23, until it assumes a horizontal position as shown in FIG. 2. A pivotally attached leg 19 (FIGS. 2 and 3) forms a permanent support for the table when pivotally moved to the vertical position shown in FIG. 2.

To anchor or steady the unit 1, a pair of legs 15 and 16 are provided for anchorage by the bottom frame of a chair or sofa (not shown) by interposing an adjustable height bolt 17 (FIG. 3) which can be selectively unscrewed and therefore increased in height sufficiently so as to form a rigid anchor between the underside of the chair frame and the tops of bolts 17, giving great stability to the assembly. Bolts 17 are mounted on notched blocks 21 slidable on top of legs 15–16.

The table 10 is selectively pivoted 180° about pivot pin 11 so as to extend from the opposite side of the open assembly shown in FIG. 2. Leg 14 which is pivotally suspended from the side of the unit (FIG. 3), is pivoted so as to extend as a brace which is secured to the side edge of the table by a headed pin 20 having a threaded shank which is screw threaded into a hole in said side edge. Another brace 14 is fastened to the opposite side of the table edge and to an intermediate portion of leg 14 by bolt 20.

The table, when in the position shown in FIG. 2, may be slid while remaining in the horizontal position, until it is alongside and confronts top portion 5, so as to serve as a desk.

Figure 3:
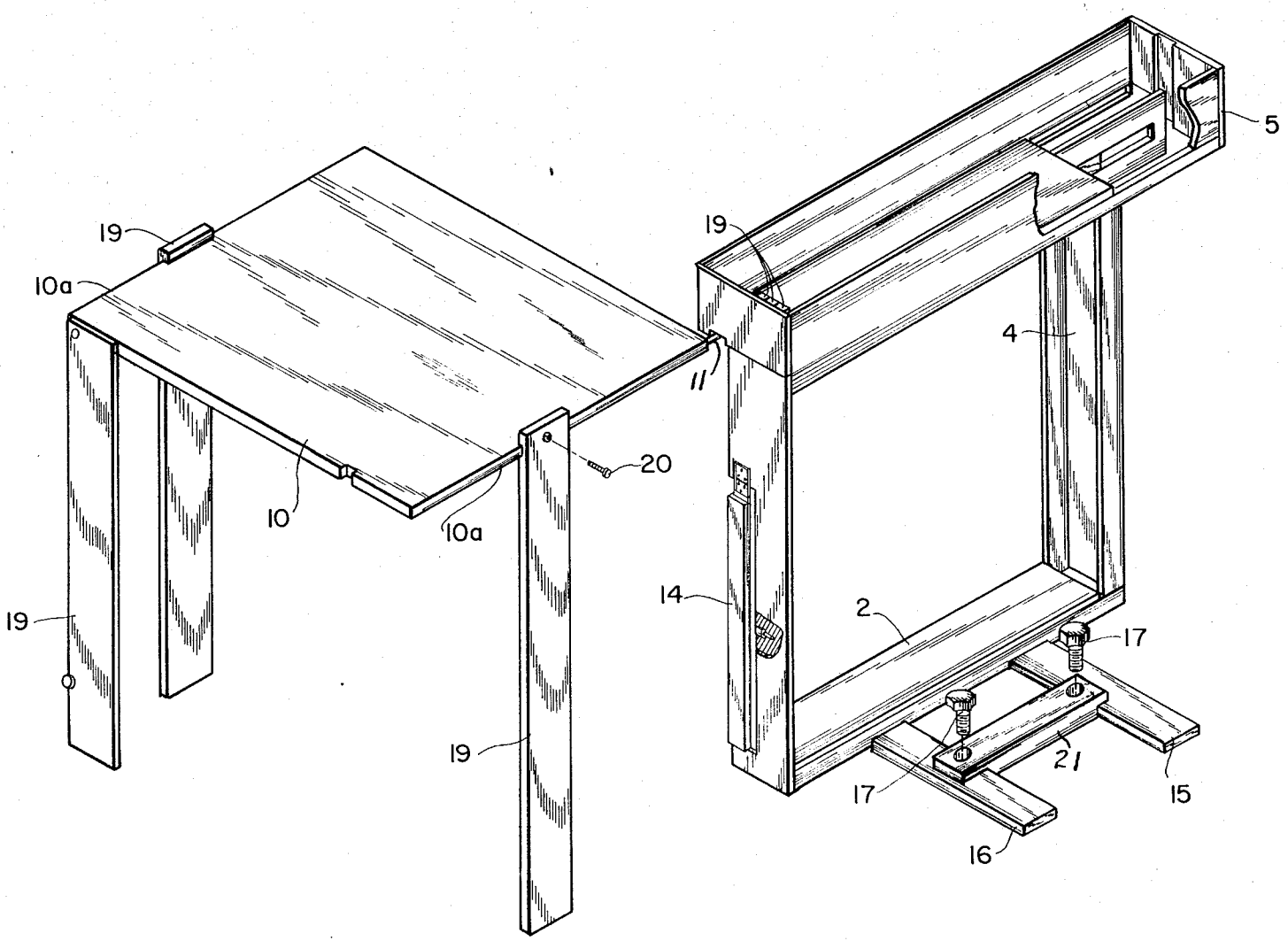
FIG. 3 is a top perspective view of the unit showing how it is anchored by an adjoining chair or sofa (not shown in the drawing) and further showing how parts are pivotally connected together.

A still further variation is when leg 19 is pivoted to a vertical position and when another leg 19, stored in the unit, is attached to the other corner. The leg 19 pivotally mounted on the edge of the table is normally in the collapsed position shown in dotted lines in FIG. 2 and held in such position by magnetic elements **19*a*, 19*b*. A free standing table 10 completely separated from the unit and somewhat as shown in FIG. 3 but without support of pin 11, by being supported by legs 19 which were stored in the unit (FIG. 1) and which can be quickly attached to sides of the table by wooden bolts 20, shown in the exploded position and which can be stored on a perforated support 21 shown in FIG. 1. Such bolts 20** may be in the form of knobs having screw-threaded shanks. These legs can be used to give strength to table at the corners and in additional different positions, as shown, for sturdier support.

Thus it will be seen that I have provided a highly versatile and efficient collapsible table unit which enables easy retraction of the table from the unit and which is so pivotally mounted as to enable the table to be erected either one one side or the other side of the unit to serve as end tables or in confronting relationship with the unit so as to serve as a desk.

While I have illustrated and described several embodiments of my invention, it will be understood that these are by way of illustration only and that various changes and modifications may be contemplated in my invention and within the scope of the following claims:

I claim:

1. A free standing collapsible table unit which is completely separate from and useful alongside any sofa or chair, said unit comprising a vertically mounted solid table that has opposite edges which are relatively slidable inwardly or outwardly of said unit, a pivot extendible outwardly of the upper edge of said table, a supporting panel into the edge of which said pivot extends, a knob attached to said supporting panel, so that by pulling the knob laterally of said unit, the table may be selectively slid inwardly or outwardly of said unit along said edges, a leg of said table which is pivotally mounted at one end of the table edge, means for temporarily holding said leg in place along the edge of said table, located at the other end of said table edge when said table is collapsed, whereby said table when pushed outwardly of said unit, may be selectively swung on said pivot into a horizontal plane so as to extend horizontally outwardly of said unit, either from the front of the unit or from the rear of the unit while supported on said leg when the leg is pivotally swung to the vertical position, and means for detachably fastening said unit to the underframe of a sofa or chair and constituting the sole means for attaching said unit thereto.

2. A collapsible table as recited in claim 1 wherein said last-mentioned means comprises horizontally extending legs secured to the base of the unit and extending in an opposite direction from that of the table so that it can be projected underneath the frame of a sofa or chair, vertical adjusting means emerging vertically from said legs so as to contact the underframe of said sofa or chair in tight relationship so as to provide lateral support for said unit and constituting the sole means for said such support.

3. A collapsible table unit as recited in claim 1, said unit including an open top box structure at the top thereof including a base means slidably mounted thereon for supporting an accessory.

4. A collapsible table unit as recited in claim 1 together with a plurality of legs extending vertically inside said unit for use to support the table when in extended position outside of said unit.

* * * * *